US011926956B2

(12) United States Patent
Nishigawa et al.

(10) Patent No.: US 11,926,956 B2
(45) Date of Patent: Mar. 12, 2024

(54) ELASTIC FIBER TREATING AGENT AND ELASTIC FIBER

(71) Applicant: TAKEMOTO YUSHI KABUSHIKI KAISHA, Aichi-ken (JP)

(72) Inventors: Takeshi Nishigawa, Gamagori (JP); Keiichiro Oshima, Gamagori (JP)

(73) Assignee: TAKEMOTO YUSHI KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 18/026,733

(22) PCT Filed: Sep. 17, 2021

(86) PCT No.: PCT/JP2021/034218
§ 371 (c)(1),
(2) Date: Mar. 16, 2023

(87) PCT Pub. No.: WO2022/065209
PCT Pub. Date: Mar. 31, 2022

(65) Prior Publication Data

US 2023/0257929 A1 Aug. 17, 2023

(30) Foreign Application Priority Data

Sep. 23, 2020 (JP) ..... 2020-158554

(51) Int. Cl.

| | |
|---|---|
| ***D06M 13/02*** | (2006.01) |
| ***D06M 13/144*** | (2006.01) |
| ***D06M 13/165*** | (2006.01) |
| ***D06M 13/224*** | (2006.01) |
| ***D06M 15/17*** | (2006.01) |
| ***D06M 15/643*** | (2006.01) |
| ***D06M 101/38*** | (2006.01) |

(52) U.S. Cl.
CPC ..... *D06M 13/02* (2013.01); *D06M 13/144* (2013.01); *D06M 13/165* (2013.01); *D06M 13/224* (2013.01); *D06M 15/17* (2013.01); *D06M 15/643* (2013.01); *D06M 2101/38* (2013.01); *D06M 2200/40* (2013.01)

(58) Field of Classification Search
CPC ..... D06M 13/02
See application file for complete search history.

(56) References Cited

U.S. PATENT DOCUMENTS 2,591,570 A * 4/1952 Manilych et al. ..... C10M 1/08 508/342

FOREIGN PATENT DOCUMENTS

| | | | | |
|---|---|---|---|---|
| EP | 0429172 | A1 | 5/1991 | |
| JP | 3-130473 | A | 6/1991 | |
| JP | 2002046021 | A * | 2/2002 | |
| JP | 2003-013362 | A | 1/2003 | |
| JP | 2003-528988 | A | 9/2003 | |
| JP | 2006-037303 | A | 2/2006 | |
| KR | 10-2008-0061130 | A | 7/2008 | |
| NO | 129502 | B * | 4/1974 | ..... B01D 19/0404 |
| WO | WO 2011/105386 | A1 | 9/2011 | |

OTHER PUBLICATIONS

English machine translation of Hata et al. JP 2002-046021A. (Year: 2002).*
English abstract of Hata et al. JP 2002-046021A. (Year: 2002).*
Lichtman et al. English machine translation of NO 129502 B. (Year: 1974).*
International Search Report and Written Opinion, dated Nov. 9, 2021, in connection with International Application No. PCT/JP2021/034218.

* cited by examiner

*Primary Examiner* — Peter F Godenschwager
(74) *Attorney, Agent, or Firm* — Wolf, Greenfield & Sacks, P.C.

(57) ABSTRACT

Disclosed is an elastic fiber treatment agent that contains at least one smoothing agent selected from the group consisting of mineral oils, silicone oils, and ester oils and at least one naturally derived ingredient selected from the group consisting of terpene resins and terpene resin derivatives. Also disclosed is an elastic fiber treatment agent that contains at least one smoothing agent selected from the group consisting of mineral oils, silicone oils, and ester oils and at least one naturally derived ingredient selected from the group consisting of rosins and rosin derivatives. In one aspect, the smoothing agent includes a mineral oil and the mineral oil content of the smoothing agent (A) is 59.5% to 95% by mass.

10 Claims, No Drawings

ELASTIC FIBER TREATING AGENT AND ELASTIC FIBER

CROSS REFERENCE TO RELATED APPLICATIONS

This Application is a national stage filing under 35 U.S.C. 371 of International Patent Application Serial No PCT/JP2021/034218, filed Sep. 17, 2021, which claims priority to Japanese application number 2020-158554, filed Sep. 23, 2020. The entire contents of these applications are incorporated herein by reference in their entirety.

TECHNICAL FIELD

The present invention relates to an elastic fiber treatment agent that contains a specific naturally derived ingredient and to an elastic fiber to which the elastic fiber treatment agent is adhered.

BACKGROUND ART

Elastic fibers, such as polyurethane elastic fibers, are strong in stickiness between the fibers in comparison to other synthetic fibers. Therefore, there is a problem in that when after elastic fibers are spun and wound into a package, the fibers are drawn out from the package to be subject to a processing step, it is difficult to unwind the fibers stably from the package. Thus, an elastic fiber treatment agent that contains a smoothing agent such as a hydrocarbon oil may be used to improve the smoothness of the elastic fibers.

An elastic fiber treatment agent as disclosed in Patent Document 1 is previously known. Patent Document 1 discloses a polyurethane elastic fiber treatment agent that contains a base ingredient, such as a silicone oil, and an acidic phosphoric acid ester salt of a bivalent cation of a group 2 element metal at a predetermined ratio.

CITATION LIST

Patent Literature

Patent Document 1: International Publication No. WO 2011/105386

SUMMARY OF INVENTION

Technical Problem

However, there has been a demand for suppression of scattering of an elastic fiber treatment agent when an elastic fiber with the treatment agent applied thereto are wound by a winder, that is, further improvement in a scattering suppression effect of the elastic fiber treatment.

Solution to Problem

As a result of performing research toward solving the above problem, the inventors of the present application have found that an elastic fiber treatment agent is suitable in which a specific smoothing agent (A) and a specific naturally derived ingredient (B) are blended.

To solve the above problem and in accordance with one aspect of the present invention, an elastic fiber treatment agent is characterized by containing at least one smoothing agent (A) selected from the group consisting of mineral oils, silicone oils, and ester oils and at least one naturally derived ingredient (B) selected from the group consisting of terpene resins and terpene resin derivatives.

In the elastic fiber treatment agent, preferably, the smoothing agent (A) includes a mineral oil and the mineral oil content of the smoothing agent (A) is 55% to 95% by mass.

To solve the above problem and in accordance with another aspect of the present invention, an elastic fiber treatment agent contains at least one smoothing agent (A) selected from the group consisting of mineral oils, silicone oils, and ester oils and at least one naturally derived ingredient (B) selected from the group consisting of rosins and rosin derivatives and is characterized in that the smoothing agent (A) includes a mineral oil and the mineral oil content of the smoothing agent (A) is 59.5% to 95% by mass.

Assuming that the sum of the content ratios of the smoothing agent (A) and the naturally derived ingredient (B) in the elastic fiber treatment agent is 100 parts by mass, the elastic fiber treatment agent preferably contains the naturally derived ingredient (B) at a ratio of 0.1 to 30 parts by mass.

The elastic fiber treatment agent preferably further contains at least one hydroxy compound (C) selected from the group consisting of aliphatic alcohols with 12 to 24 carbon atoms and alkylene oxide adducts of higher alcohols in which 1 to 100 moles of an alkylene oxide with 2 to 4 carbon atoms is added per 1 mole of an aliphatic alcohol with 12 to 24 carbon atoms.

Assuming that the sum of the content ratios of the smoothing agent (A), the naturally derived ingredient (B), and the hydroxy compound (C) in the elastic fiber treatment agent is 100 parts by mass, the elastic fiber treatment agent preferably contains the naturally derived ingredient (B) at a ratio of 0.1 to 30 parts by mass.

To solve the above problem and in accordance with another aspect of the present invention, elastic fibers of another aspect of the present invention are characterized in having the elastic fiber treatment agent adhered thereto.

Advantageous Effects of Invention

The present invention succeeds in improving a scattering suppression effect of an elastic fiber treatment agent.

DESCRIPTION OF EMBODIMENTS

First Embodiment

A first embodiment in which an elastic fiber treatment agent (also referred to hereinafter as treatment agent) of the present invention is embodied will now be described. The treatment agent of the present embodiment contains specific smoothing agent (A) and naturally derived ingredient (B) and may further contain a hydroxy compound.

The smoothing agent (A) is blended in the treatment agent as a base ingredient and serves a role of imparting smoothness to an elastic fiber. Examples of the smoothing agent (A) include a mineral oil, a silicone oil, and an ester oil.

Examples of the mineral oil include an aromatic hydrocarbon, a paraffin hydrocarbon, and a naphthene hydrocarbon. More specific examples thereof include spindle oil and liquid paraffin. As the mineral oil, a commercially available product specified by, for example, the viscosity may be used as appropriate.

Specific examples of the silicone oil include dimethyl silicones, phenyl-modified silicones, amino-modified silicones, amide-modified silicones, polyether-modified silicones, aminopolyether-modified silicones, alkyl-modified silicones, alkylaralkyl-modified silicones, alkylpolyether-modified silicones, ester-modified silicones, epoxy-modified silicones, carbinol-modified silicones, mercapto-modified silicones, and polyoxyalkylene-modified silicones. As the silicone oil, a commercially available product specified by, for example, the kinematic viscosity may be used as appropriate. The kinematic viscosity is set as appropriate, and the kinematic viscosity at 25° C. is preferably 2 to 100 cst ($mm^2/s$). The kinematic viscosity at 25° C. is measured in accordance with JIS Z 8803.

The ester oil is not limited in particular and, example thereof include an ester oil produced from a fatty acid and an alcohol. The ester oil is, for example, an ester oil produced from a fatty acid having an odd or even number of hydrocarbon groups and an alcohol, which will be described later.

The fatty acid that is a raw material of the ester oil is not limited in particular in regard to, for example, the number of carbon atoms, whether or not it is branched, or valence, and may be, for example, a higher fatty acid, a fatty acid having a cyclo ring, or a fatty acid having an aromatic ring. The alcohol that is a raw material of the ester oil is not limited in particular in regard to, for example, the number of carbon atoms, whether or not it is branched, or valence, and may be, for example, a higher alcohol, an alcohol having a cyclo ring, or an alcohol having an aromatic ring.

Specific examples of the ester oil include (1) ester compounds of an aliphatic monoalcohol and an aliphatic monocarboxylic acid, such as octyl palmitate, oleyl laurate, oleyl oleate, isotridecyl stearate, and isotetracosyl oleate, (2) ester compounds of an aliphatic polyhydric alcohol and an aliphatic monocarboxylic acid, such as 1,6-hexanediol didecanoate, glycerin trioleate, trimethylolpropane trilaurate, and pentaerythritol tetraoctanoate, (3) ester compounds of an aliphatic monoalcohol and an aliphatic polyvalent carboxylic acid, such as dioleyl azelate, dioleyl thiodipropionate, diisocetyl thiodipropionate, and diisostearyl thiodipropionate, (4) ester compounds of an aromatic monoalcohol and an aliphatic monocarboxylic acid, such as benzyl oleate and benzyl laurate, (5) complete ester compounds of an aromatic polyhydric alcohol and an aliphatic monocarboxylic acid, such as bisphenol A dilaurate, (6) complete ester compounds of an aliphatic monoalcohol and an aromatic polyvalent carboxylic acid, such as bis-2-ethylhexylphthalate, diisostearyl isophthalate, and trioctyl trimellitate, and (7) natural oils and fats, such as coconut oil, rapeseed oil, sunflower oil, soybean oil, castor oil, sesame oil, fish oil, and beef tallow.

With the smoothing agent (A), one type of smoothing agent may be used alone, or two or more types of smoothing agents may be used in combination.

In the present embodiment, within a range that does not impair the effects of the present invention, a smoothing agent other than those mentioned above may be used in combination. As the smoothing agent other than the above ones, a known smoothing agent may be used as appropriate. Examples of the smoothing agent other than the above ones include a polyolefin.

As the polyolefin, a poly-α-olefin used as a smoothing ingredient is used. Specific examples of the polyolefin include poly-α-olefins obtained by polymerizing, for example, 1-butene, 1-hexene, or 1-decene. As the poly-α-olefin, a commercially available product may be used as appropriate.

In the preferred embodiment, the smoothing agent (A) preferably includes a mineral oil. The mineral oil content of the smoothing agent (A) is preferably 55% to 95% by mass. By specifying the mineral oil content to be in this range, shape characteristics can be improved further. The mineral oil content of the smoothing agent (A) is, for example, not less than 33.3% by mass, not less than 46.2% by mass, not less than 57.9% by mass, not less than 59.5% by mass, not less than 62.0% by mass, not less than 64.7% by mass, not less than 67.3% by mass, not less than 67.6% by mass, not less than 67.7% by mass, not less than 68.4% by mass, or not less than 69.4% by mass. Also, the mineral oil content of the smoothing agent (A) is, for example, 88.9% by mass, not more than 69.4% by mass, not more than 68.4% by mass, not more than 67.7% by mass, not more than 67.6% by mass, not more than 67.3% by mass, not more than 64.7% by mass, not more than 62.0% by mass, not more than 59.5% by mass, not more than 57.9% by mass, or not more than 46.2% by mass.

The naturally derived ingredient (B) is at least one selected from the group consisting of rosins, rosin derivatives, terpene resins, and terpene resin derivatives. With the naturally derived ingredient (B), one type of naturally derived ingredient may be used alone, or two or more types of naturally derived ingredients may be used in combination. A rosin is a natural resin obtained from a pine and has abietic acid or a mixture of isomers thereof as a main ingredient. A rosin derivative may be used in place of the rosin or in addition to the rosin. Examples of the rosin derivative include a hydrogenation, dehydrogenation, amidation, or esterification compound of abietic acid or a mixture of isomers thereof, an EO or PO adduct, a glycidyl esterification product, an acrylated rosin, a rosin-containing diol, and a partial metal salt. As the rosin or rosin derivative, a commercially available product specified by, for example, the softening point, viscosity, or average molecular weight may be used as appropriate.

A terpene resin is obtained by cationic polymerization using as a raw material a terpene compound collected from a pine tree or an orange peel. The terpene resin may be polyterpene resin that is a homopolymer of a terpene monomer. A terpene resin derivative may be used in place of the terpene resin or in addition to the terpene resin. Examples of the terpene resin derivative include an aromatic modified terpene resin obtained by copolymerizing a terpene monomer and an aromatic monomer, a terpene phenolic resin obtained by reacting a terpene monomer with a phenol, and a hydrogenated terpene resin obtained by hydrogenation. As the terpene resin or terpene resin derivative, a commercially available product specified by, for example, the softening point may be used as appropriate.

Among these, a rosin or a rosin derivative is preferably used. By a rosin or a rosin derivative being used, a scattering suppression effect of the treatment agent can be improved further.

Specific examples of the naturally derived ingredient (B) include a polymerized rosin resin ("Pensel D-160" manufactured by Arakawa Chemical Industries, Ltd., softening point (ring and ball method): 160° C.), a polymerized rosin resin ("Pensel D-135" manufactured by Arakawa Chemical Industries, Ltd., softening point (ring and ball method): 135° C.), a rosin ester resin ("Super Ester A-75" manufactured by Arakawa Chemical Industries, Ltd., softening point (ring and ball method): 75° C.), a rosin ester resin ("Super Ester A-100" manufactured by Arakawa Chemical Industries, Ltd., softening point (ring and ball method): 100° C.), a rosin ester resin ("Super Ester A-125" manufactured by Arakawa Chemical Industries, Ltd., softening point (ring and ball method): 125° C.), a liquid rosin derivative ("Pinecrystal ME-GH" manufactured by Arakawa Chemical Industries, Ltd., viscosity (40° C.): 830 mPas), a terpene phenolic resin ("YS Polyster T-130" manufactured by Yasuhara Chemical Co., Ltd., softening point: 130° C.), and a terpene phenolic resin ("YS Polyster T-100" manufactured by Yasuhara Chemical Co., Ltd., softening point: 100° C.).

Assuming that the sum of the content ratios of the smoothing agent (A) and the naturally derived ingredient (B) in the treatment agent is 100 parts by mass, the treatment agent preferably contains the naturally derived ingredient (B) at a ratio of 0.1 to 30 parts by mass. By specifying to be in such range, the effects of the present invention can be improved further.

Assuming that the sum of the content ratios of the smoothing agent (A) and the naturally derived ingredient (B) in the treatment agent is 100 parts by mass, the treatment agent preferably contains the smoothing agent (A) at a ratio of 80 to 99.9 parts by mass and the naturally derived ingredient (B) at a ratio of 0.1 to 20 parts by mass. By specifying to be in such range, the effects of the present invention can be improved further.

The treatment agent of the present embodiment may further contain at least one hydroxy compound (C) selected from the group consisting of aliphatic alcohols with 12 to 24 carbon atoms as higher alcohols and alkylene oxide adducts of higher alcohols in which 1 to 100 moles of an alkylene oxide with 2 to 4 carbon atoms is added per 1 mole of an aliphatic alcohol with 12 to 24 carbon atoms. By such a hydroxy compound (C) being blended, a cob-webbing preventing property, which will be described later, can be improved further.

The aliphatic alcohols with 12 to 24 carbon atoms are not limited in particular in terms of the presence or absence of an unsaturated bond, and may be alcohols having a linear or branched hydrocarbon group or alcohols having a cyclo ring. In the case of an alcohol having a branched hydrocarbon group, the branching position thereof is not limited in particular. For example, the hydrocarbon group may have a carbon chain branched at an α-position or a carbon chain branched at a β-position. The alcohol may be a primary alcohol or may be a secondary alcohol.

Specific examples of the aliphatic alcohols include monohydric alcohols, such as lauryl alcohol, tridecyl alcohol, myristyl alcohol, pentadecyl alcohol, cetanol, stearyl alcohol, eicosanol, behenyl alcohol, tetracosanol, oleyl alcohol, 12-eicosyl alcohol, hexadecenyl alcohol, eicosenyl alcohol, octadecenyl alcohol, docosyl alcohol, isododecyl alcohol, isotridecyl alcohol, isomyristyl alcohol, isohexadecyl alcohol, isostearyl alcohol, and isotetracosanol.

If a compound with an alkylene oxide added is used, specific examples of the alkylene oxide include alkylene oxides with 2 to 4 carbon atoms, such as ethylene oxide, propylene oxide, and butylene oxide. The number of added moles of alkylene oxide with respect to 1 mole of the higher alcohol is preferably 1 to 100 moles, more preferably 1 to 50 moles, and even more preferably 1 to 30 moles. The number of added moles of alkylene oxide represents the number of moles of the alkylene oxide with respect to 1 mole of the aliphatic alcohol in charged raw materials.

With the hydroxy compound, one type of hydroxy compound may be used alone, or two or more types of hydroxy compounds may be used in appropriate combination.

Assuming that the sum of the content ratios of the smoothing agent (A), the naturally derived ingredient (B), and the hydroxy compound (C) in the treatment agent is 100 parts by mass, the treatment agent preferably contains the naturally derived ingredient (B) at a ratio of 0.1 to 30 parts by mass. By specifying to be in such range, the effects of the present invention can be improved further.

Assuming that the sum of the content ratios of the smoothing agent (A), the naturally derived ingredient (B), and the hydroxy compound (C) in the treatment agent is 100 parts by mass, the treatment agent preferably contains the smoothing agent (A) at a ratio of 60 to 99.8 parts by mass, the naturally derived ingredient (B) at a ratio of 0.1 to 20 parts by mass, and the hydroxy compound (C) at a ratio of 0.1 to 20 parts by mass. By specifying to be in such range, the effects of the present invention can be improved further.

Second Embodiment

Next, a second embodiment in which an elastic fiber according to the present invention is embodied will be described. The treatment agent of the first embodiment is adhered to an elastic fiber of the present embodiment. The amount of the treatment agent of the first embodiment (not including a solvent) adhered to the elastic fiber is not limited in particular, and the treatment agent is adhered at a ratio of preferably 0.1% to 10% by mass from a standpoint of improving the effects of the present invention further.

The elastic fiber is no limited in particular, and examples thereof include polyester elastic fibers, polyamide elastic fibers, polyolefin elastic fibers, and polyurethane elastic fibers. Among these, a polyurethane elastic fiber is preferable. In this case, higher expression of the effects of the present invention can be achieved.

The method for manufacturing the elastic fiber of the present invention includes feeding the treatment agent of the first embodiment to an elastic fiber. As a method for feeding the treatment agent, a method of adhering the treatment agent to the elastic fiber in a step of spinning the elastic fiber by a neat feeding method without dilution is preferable. As an adhesion method, for example, a known method such as a roller lubrication method, a guide lubrication method, or a spray lubrication method can be used. In general, a lubrication roller is ordinarily positioned at a point between a spinneret and a winding traverse, and can also be applied to the manufacturing method of the present embodiment. Among the above, it is preferable to adhere the treatment agent of the first embodiment to an elastic fiber, for example, a polyurethane elastic fiber by a lubrication roller positioned between stretching rollers because the effects are remarkably exhibited.

The method for manufacturing the elastic fiber itself applied to the present embodiment is not restricted in particular, and the elastic fiber can be manufactured by a known method. Examples of the method include a wet spinning method, a melt spinning method, and a dry spinning method. Among these, a dry spinning method is preferable from a standpoint that quality and manufacturing efficiency of the elastic fiber are excellent.

The operation and effects of the treatment agent and the elastic fiber of the embodiments will now be described.

(1) The treatment agent of the embodiments contains the at least one smoothing agent (A) selected from the group consisting of mineral oils, silicone oils, and ester oils and the at least one naturally derived ingredient (B) selected from the group consisting of rosins, rosin derivatives, terpene resins, and terpene resin derivatives. The elastic fiber to which the treatment agent has been applied can thus be improved in scattering suppression effect of the treatment agent especially during winding by a winder. Also, the elastic fiber to which the treatment agent has been applied can be improved in shape characteristics, especially, shape characteristics when wound into a cheese shape. Also, the cob-webbing preventing property of the elastic fiber to which the treatment agent has been applied can be improved.

The above-described embodiments may be modified as follows. The above-described embodiments and the following modifications can be implemented in combination with each other within a range that is not technically inconsistent.

The treatment agent of the above-described embodiments may further have blended therein a stabilizer, an antistatic agent, a binder, an antioxidant, an ultraviolet absorber, and other ingredients that are ordinarily used in treatment agents for quality maintenance of the treatment agent within a range that does not impair the effects of the present invention.

EXAMPLES

Examples will now be given below to describe the features and effects of the present invention more specifically, but the present invention is not restricted to these examples. In the following description of working examples and comparative examples, "parts" means parts by mass and "%" means % by mass.

Experimental Part 1 (Preparation of elastic fiber treatment agents)

Treatment agents used in the respective examples and respective comparative examples were prepared using respective ingredients indicated in Table 1 by a preparation method described below.

55 parts (%) of a mineral oil (viscosity at 40° C. of 60 seconds as measured by a Redwood viscometer) (A-1), 30 parts (%) of a dimethyl silicone (10 cst ($mm^2/s$), 25° C.) (A-3), 7 parts (%) of a polymerized rosin resin (B-1) as a naturally derived ingredient, and 8 parts (%) of isostearyl alcohol (C-1) as a hydroxy compound were mixed well and made uniform to prepare a treatment agent of Example 1.

For each of Examples 2 to 15 and 19 to 22, Reference Examples 16 and 18, and Comparative Examples 1 and 2, a treatment agent was prepared in the same manner as in Example 1 by mixing smoothing agents, a naturally derived ingredient, and a hydroxy compound at ratios indicated in Table 1.

The types of the smoothing agent (A), the naturally derived ingredient (B), and the hydroxy compound (C) and ratios of the respective ingredients if the sum of the content ratios of the ingredients in the treatment agent of each example is taken as 100% are respectively indicated in the "Smoothing agent (A)" column, the "Naturally derived ingredient (B)" column, and the "Hydroxy compound (C)" column of Table 1.

TABLE 1

| | Elastic fiber treatment agent | | | | | | | | | Evaluation | | |
|---|---|---|---|---|---|---|---|---|---|---|---|---|
| | Smoothing agent (A) | | | | | Naturally derived ingredient (B) | | Hydroxy compound (C) | | | | |
| | Mineral oil | | Other | | Mineral oil content of | | | | | | | Cob-webbing |
| Category | Type | Parts by mass | Type | Parts by mass | smoothing agent (A) (% by mass) | Type | Parts by mass | Type | Parts by mass | Scattering | Shape | preventing property |
| Example 1 | A-1 | 55 | A-3 | 30 | 64.7 | B-1 | 7 | C-1 | 8 | ○○ | ○○ | ○○ |
| Example 2 | A-1<br>A-2 | 20<br>35 | A-3 | 30 | 64.7 | B-1 | 7 | C-1 | 8 | ○○ | ○○ | ○○ |
| Example 3 | A-1 | 55 | A-3<br>A-4 | 20<br>10 | 64.7 | B-1 | 7 | C-1 | 8 | ○○ | ○○ | ○○ |
| Example 4 | A-1 | 55 | A-3 | 30 | 64.7 | B-2 | 7 | C-1 | 8 | ○○ | ○○ | ○○ |
| Example 5 | A-1 | 55 | A-3 | 30 | 64.7 | B-3 | 7 | C-1 | 8 | ○○ | ○○ | ○○ |
| Example 6 | A-1 | 55 | A-3 | 30 | 64.7 | B-4 | 7 | C-1 | 8 | ○○ | ○○ | ○○ |
| Example 7 | A-1 | 55 | A-3 | 30 | 64.7 | B-5 | 7 | C-1 | 8 | ○○ | ○○ | ○○ |
| Example 8 | A-1 | 55 | A-3 | 30 | 64.7 | B-6 | 7 | C-1 | 8 | ○○ | ○○ | ○○ |
| Example 9 | A-1 | 61.7 | A-3 | 30 | 67.3 | B-1 | 0.3 | C-1 | 8 | ○○ | ○○ | ○○ |
| Example 10 | A-1 | 68 | A-3 | 30 | 69.4 | B-1 | 1 | C-1 | 1 | ○○ | ○○ | ○○ |
| Example 11 | A-1 | 44 | A-3 | 30 | 59.5 | B-1 | 18 | C-1 | 8 | ○○ | ○○ | ○○ |
| Example 12 | A-1 | 55 | A-3 | 30 | 64.7 | B-1 | 7 | C-2 | 8 | ○○ | ○○ | ○○ |
| Example 13 | A-1 | 62.7 | A-3 | 30 | 67.6 | B-1 | 7 | C-1 | 0.3 | ○○ | ○○ | ○○ |
| Example 14 | A-1 | 49 | A-3 | 30 | 62.0 | B-1 | 3 | C-1 | 18 | ○○ | ○○ | ○○ |
| Example 15 | A-1 | 80 | A-3 | 10 | 88.9 | B-1 | 5 | C-1 | 5 | ○○ | ○○ | ○○ |
| Reference example 16 | A-1 | 30 | A-3 | 60 | 33.3 | B-1 | 5 | C-1 | 5 | ○○ | ○○ | ○○ |
| Example 17 | A-1 | 65 | A-3 | 30 | 68.4 | B-1 | 5 | — | 0 | ○○ | ○○ | ○ |
| Reference example 18 | A-1 | 55 | A-3 | 40 | 57.9 | B-1 | 5 | — | 0 | ○○ | ○ | ○ |
| Example 19 | A-1 | 55 | A-3 | 30 | 64.7 | B-7 | 7 | C-1 | 8 | ○ | ○○ | ○○ |
| Example 20 | A-1 | 63 | A-3 | 30 | 67.7 | B-7 | 7 | — | 0 | ○ | ○○ | ○ |
| Example 21 | A-1 | 43 | A-3 | 50 | 46.2 | B-7 | 7 | — | 0 | ○ | ○ | ○ |
| Example 22 | A-1 | 43 | A-3 | 50 | 46.2 | B-8 | 7 | — | 0 | ○ | ○ | ○ |
| Comparative example 1 | A-1 | 60 | A-3 | 30 | 66.7 | — | — | C-1 | 10 | x | x | x |
| Comparative example 2 | A-1 | 50 | A-3 | 50 | 50.0 | — | — | — | 0 | x | x | x |

Details of A-1 to A-4, B-1 to B-8, C-1, and C-2 indicated in Table 1 are as follows.

(Smoothing agents (A))

A-1: mineral oil (viscosity at 40° C. of 60 seconds as measured by a Redwood viscometer)

A-2: mineral oil (viscosity at 40° C. of 100 seconds as measured by a Redwood viscometer)

A-3: dimethyl silicone (10 cst ($mm^2/s$), 25° C.)

A-4: isotridecyl stearate (Naturally derived ingredients (B))

B-1: polymerized rosin resin ("Pensel D-160" manufactured by Arakawa Chemical Industries, Ltd., softening point: 160° C.)

B-2: polymerized rosin resin ("Pensel D-135" manufactured by Arakawa Chemical Industries, Ltd., softening point: 135° C.)

B-3: rosin ester resin ("Super Ester A-75" manufactured by Arakawa Chemical Industries, Ltd., softening point: 75° C.)

B-4: rosin ester resin ("Super Ester A-100" manufactured by Arakawa Chemical Industries, Ltd., softening point: 100° C.)

B-5: rosin ester resin ("Super Ester A-125" manufactured by Arakawa Chemical Industries, Ltd., softening point: 125° C.)

B-6: liquid rosin derivative ("Pinecrystal ME-GH" manufactured by Arakawa Chemical Industries, Ltd., viscosity (40° C.): 830 mPas)

B-7: terpene phenolic resin ("YS Polyster T-130" manufactured by Yasuhara Chemical Co., Ltd., softening point: 130° C.)

B-8: terpene phenolic resin ("YS Polyster T-100" manufactured by Yasuhara Chemical Co., Ltd., softening point: 100° C.)

(Hydroxy compounds (C))

C-1: isostearyl alcohol

C-2: 3 mole ethylene oxide adduct of isotridecyl alcohol

Experimental Part 2 (Manufacture of elastic fibers)

A prepolymer obtained from a polytetramethylene glycol with a molecular weight of 1000 and diphenylmethane diisocyanate was made to undergo a chain extension reaction by ethylenediamine in a dimethylformamide solution to obtain a spinning dope of 30% concentration. The spinning dope was dry spun in a heated gas flow from a spinneret. Each treatment agent prepared in Experimental Part 1 was then neat-fed by a roller lubrication method onto the dry-spun polyurethane elastic fibers. Subsequently, the polyurethane elastic fibers with the treatment agent applied thereto were wound into a package to obtain treated polyurethane elastic fibers of 20 denier (monofilament). The adhesion amount of the treatment agent was adjusted to be 5% in all cases by adjusting a rotation speed of the lubrication roller.

Using the elastic fibers or the packages of roller-lubricated, dry-spun polyurethane elastic fibers thus obtained, a scattering suppression effect as well as a shape characteristic and a cob-webbing preventing property of the elastic fibers were evaluated as described below.

Experimental Part 3 (Evaluation of elastic fibers)

Scattering suppression effect

A scattered amount of the treatment agent seen near a winder when the obtained dry-spun polyurethane elastic fiber package (500 g winding) immediately after spinning was wound for 30 minutes at a delivery speed of 100 m/minute and a winding speed of 250 m/minute was visually observed. The observation of the scattered amount was performed by placing a cardboard below the winder and observing the treatment agent that became adhered to the cardboard. The results evaluated by criteria given below are shown in the "Scattering" column of Table 1.

○○ (good): No scattering was seen.

○ (fair): Slight scattering was seen.

x (poor): Considerable scattering was seen.

· Evaluation of shape characteristic

Each treatment agent prepared in Experimental Part 1 was adhered at 5.0% to polyurethane elastic fibers of 20 denier (monofilament) by the roller lubrication method. A package of the polyurethane-elastic fibers was then obtained by using a surface-driven winder to wind 500 g around a cylindrical paper tube of 57 mm length at a winding speed of 550 m/minute via a traverse guide that realizes a winding width of 42 mm.

A maximum value (Wmax) and a minimum width (Wmin) of the winding width of the obtained polyurethane elastic fiber package (500 g winding) was measured, and a bulge was determined from a difference between the two (Wmax−Wmin) and evaluated based on criteria given below. The results are indicated in the "Shape" column of Table 1.

○○ (good): The bulge was less than 3 mm.

○ (fair): The bulge was not less than 3 mm but less than 6 mm.

x (poor): The bulge was not less than 6 mm.

· Evaluation of cob-webbing preventing property

The number of times yarn breakage occurred due to cob-webbing of the obtained dry-spun polyurethane elastic fiber package (500 g winding) immediately after spinning when 1000 m of the package were wound at a delivery speed of 20 m/minute and a winding speed of 40 m/minute was evaluated by criteria given below. The results are shown in the "Cob-webbing preventing property" column of Table 1.

○○ (good): Yarn breakage due to cob-webbing occurred 0 times.

○ (fair): Yarn breakage due to cob-webbing occurred not less than 1 time but less than 3 times.

x (poor): Yarn breakage due to cob-webbing occurred not less than 3 times.

As is clear from the evaluation results of the respective examples relative to the respective comparative examples in Table 1, the treatment agent of the present invention can suppress the scattering of the treatment agent from the elastic fibers to which the treatment agent has been applied. In addition, the shape characteristics and the cob-webbing preventing property can be improved.

The present invention also encompasses the following embodiments.

Additional Embodiment 1

An elastic fiber treatment agent comprising at least one smoothing agent (A) selected from the group consisting of mineral oils, silicone oils, and ester oils and at least one naturally derived ingredient (B) selected from the group consisting of rosins, rosin derivatives, terpene resins, and terpene resin derivatives.

Additional Embodiment 2

The elastic fiber treatment agent according to additional embodiment 1, wherein the naturally derived ingredient (B) is at least one selected from the group consisting of rosins and rosin derivatives.

Additional Embodiment 3

The elastic fiber treatment agent according to additional embodiment 1 or 2, wherein the smoothing agent (A)

includes a mineral oil and the mineral oil content of the smoothing agent (A) is 55% to 95% by mass.

Additional Embodiment 4

The elastic fiber treatment agent according to any one of additional embodiments 1 to 3, wherein assuming that the sum of the content ratios of the smoothing agent (A) and the naturally derived ingredient (B) in the elastic fiber treatment agent is 100 parts by mass, the elastic fiber treatment agent contains the naturally derived ingredient (B) at a ratio of 0.1 to 30 parts by mass.

Additional Embodiment 5

The elastic fiber treatment agent according to any one of additional embodiments 1 to 4, further comprising at least one hydroxy compound (C) selected from the group consisting of aliphatic alcohols with 12 to 24 carbon atoms and alkylene oxide adducts of higher alcohols in which 1 to 100 moles of an alkylene oxide with 2 to 4 carbon atoms is added per 1 mole of an aliphatic alcohol with 12 to 24 carbon atoms.

Additional Embodiment 6

The elastic fiber treatment agent according to additional embodiment 5, wherein assuming that the sum of the content ratios of the smoothing agent (A), the naturally derived ingredient (B), and the hydroxy compound (C) in the elastic fiber treatment agent is 100 parts by mass, the elastic fiber treatment agent contains the naturally derived ingredient (B) at a ratio of 0.1 to 30 parts by mass.

Additional Embodiment 7

An elastic fiber comprising the elastic fiber treatment agent according to any one of additional embodiments 1 to 6 adhered thereto.

The invention claimed is:

1. An elastic fiber treatment agent comprising:

a smoothing agent (A) containing a mineral oil and a smoothing agent other than mineral oils; and at least one naturally derived ingredient (B) selected from the group consisting of terpene resins and terpene resin derivatives, wherein the mineral oil content of the smoothing agent (A) is 55% to 95% by mass.

2. The elastic fiber treatment agent according to claim 1, wherein assuming that the sum of the content ratios of the smoothing agent (A) and the naturally derived ingredient (B) in the elastic fiber treatment agent is 100 parts by mass, the elastic fiber treatment agent contains the naturally derived ingredient (B) at a ratio of 0.1 to 30 parts by mass.

3. The elastic fiber treatment agent according to claim 1, further comprising at least one hydroxy compound (C) selected from the group consisting of aliphatic alcohols with 12 to 24 carbon atoms and alkylene oxide adducts of higher alcohols in which 1 to 100 moles of an alkylene oxide with 2 to 4 carbon atoms is added per 1 mole of an aliphatic alcohol with 12 to 24 carbon atoms.

4. The elastic fiber treatment agent according to claim 3, wherein assuming that the sum of the content ratios of the smoothing agent (A), the naturally derived ingredient (B), and the hydroxy compound (C) in the elastic fiber treatment agent is 100 parts by mass, the elastic fiber treatment agent contains the naturally derived ingredient (B) at a ratio of 0.1 to 30 parts by mass.

5. An Elastic fiber comprising the elastic fiber treatment agent according to claim 1 adhered thereto.

6. An elastic fiber treatment agent comprising:

a smoothing agent (A) containing a mineral oil and a silicone oil; and at least one naturally derived ingredient (B) selected from the group consisting of rosins and rosin derivatives, wherein the mineral oil content of the smoothing agent (A) is 59.5% to 95% by mass.

7. The elastic fiber treatment agent according to claim 6, wherein assuming that the sum of the content ratios of the smoothing agent (A) and the naturally derived ingredient (B) in the elastic fiber treatment agent is 100 parts by mass, the elastic fiber treatment agent contains the naturally derived ingredient (B) at a ratio of 0.1 to 30 parts by mass.

8. The elastic fiber treatment agent according to claim 6, further comprising at least one hydroxy compound (C) selected from the group consisting of aliphatic alcohols with 12 to 24 carbon atoms and alkylene oxide adducts of higher alcohols in which 1 to 100 moles of an alkylene oxide with 2 to 4 carbon atoms is added per 1 mole of an aliphatic alcohol with 12 to 24 carbon atoms.

9. The elastic fiber treatment agent according to claim 8, wherein assuming that the sum of the content ratios of the smoothing agent (A), the naturally derived ingredient (B), and the hydroxy compound (C) in the elastic fiber treatment agent is 100 parts by mass, the elastic fiber treatment agent contains the naturally derived ingredient (B) at a ratio of 0.1 to 30 parts by mass.

10. An Elastic fiber comprising the elastic fiber treatment agent according to claim 6 adhered thereto.

* * * * *